United States Patent [19]

Holmes

[11] 4,164,044

[45] Aug. 14, 1979

[54] ADJUSTABLE WAIST BAND FOR JEANS

[76] Inventor: Marion D. Holmes, 9838 57th Ave., Rego Park, N.Y. 11368

[21] Appl. No.: 830,056

[22] Filed: Sep. 2, 1977

[51] Int. Cl.[2] ..... A41F 9/02

[52] U.S. Cl. ..... 2/237

[58] Field of Search ..... 2/237, 221, 76, 227

[56] References Cited

U.S. PATENT DOCUMENTS

| | | | |
|---|---|---|---|
| 701,252 | 5/1902 | Bandler | 2/237 |
| 1,018,012 | 2/1912 | Shapiro | 2/221 |
| 1,022,410 | 4/1912 | Freedman | 2/221 |
| 2,108,175 | 2/1938 | Miller | 2/237 |
| 2,216,030 | 9/1940 | Bardsley | 2/237 |
| 3,234,564 | 2/1966 | Chujfi | 2/227 |
| 3,793,645 | 2/1974 | Kadison | 2/221 |
| 3,839,740 | 10/1974 | Tornberg | 2/237 |

FOREIGN PATENT DOCUMENTS

| | | | |
|---|---|---|---|
| 430237 | 10/1911 | France | 2/237 |
| 470285 | 8/1937 | United Kingdom | 2/237 |

*Primary Examiner*—H. Hampton Hunter

*Attorney, Agent, or Firm*—Peter L. Berger

[57] ABSTRACT

An adjustable waist band for jeans and the like is disclosed in which conventional brass-like snaps are utilized to accomplish the adjusting feature. The employment of brass-like snaps which are viewable makes it appear that the snaps are part of a normal, non-functional, ornamental design so that the adjustability of the waist band is achieved without detracting from the appearance of the jeans. Further, by employing brass-like snaps, the appearance of the jeans is even further enhanced.

5 Claims, 3 Drawing Figures

ADJUSTABLE WAIST BAND FOR JEANS

PRIOR ART STATEMENT

Applicant has conducted a search in which the following references were developed:

U.S. Pat. No. Re. 16,179—M. Weiner et al
U.S. Pat. No. 195,894—S. Kauffmann
U.S. Pat. No. 573,292—C. J. Raiffeisen
U.S. Pat. No. 701,252—H. Bandler
U.S. Pat. No. 1,033,714—P. A. Lewis
U.S. Pat. No. 1,713,121—M. Goodman
U.S. Pat. No. 2,108,175—H. E. Miller
U.S. Pat. No. 2,126,122—B. Mainzer
U.S. Pat. No. 2,216,030—H. C. Bardsley
U.S. Pat. No. 3,839,740—William Tornberg The patents to Tornberg, U.S. Pat. No. 3,839,740 and Bandler, U.S. Pat. No. 701,252 are closest to applicant's invention. The remaining patents were discovered, but are less relevant to applicant's invention and merely recite conventional, well-known, adjustable waist band devices.

The patents to Bandler and Tornberg provide for adjusting the waist band with adjustable members off the center on either side of the front of the waist band, and the trousers illustrated appear to be jeans or the like. In the Tornberg patent, a snap fastener 17 is utilized, but this snap fastener is hidden from view, so that the adjustability is concealed. The snaps are not ornamentally displayed. In the Bandler patent, hook and eye members are employed to adjust the waist band, and there are also hidden from view so that the adjustable feature does not enhance the ornamental appearance of the trousers.

BACKGROUND OF THE INVENTION

This invention relates to an adjustable waist band for jeans and the like, where such jeans and the like normally utilize brass-like ornamental snap fasteners, such as brass, pearl or enamel.

As illustrated in the above prior art patents discussed, adjustable waist bands for trousers and the like are old in the art. Conventionally, these are viewed by the manufacturers as unattractive and unsightly, and great lengths are employed to hide the adjustability feature from normal view. Therefore, hooks and eyes and other members are employed which are hidden within folds or pleats of the trouser waist band in order to allow the waist band adjustment to be effected without detracting from the appearance of the trousers.

An object of this invention is to provide an adjustable waist band device which effectively accomplishes the adjustment but also enhances the ornamental appearance of the trousers.

Still another object of this invention is to provide such an adjustable waist band for jeans and the like which makes it appear that the adjustable feature is part of the normal ornamental design of the trousers, thus hiding the adjustable feature while enhancing the appearance of the jeans.

Another object of this invention is to provide such a device which is capable of a broad and wide range of adjustments without detracting from the appearance of the trousers.

Another object of this invention is to provide such an adjustable device which is simple and effective to use and inexpensive to manufacture and produce, employing conventionally employed members and elements utilized for most jeans and the like.

SUMMARY OF THE INVENTION

The above objects are accomplished, in accordance with the teachings of this invention, by providing snap fastening members for accomplishing the adjustment of the waist band of the jeans which comprise a waist band section affixed to the jeans partially encircling the wearer, and terminating with a gap in front of the wearer, the waist band section including male snap members horizontally spaced apart affixed to each side of the section forming the gap. There is further provided a front closing section bridging the gap, closing the waist band section, the closing section having brass-like female snap members which cooperate with the male snap members affixed to the waist band section so that the adjustable feature is achieved while presenting only ornamental snaps. The front closing may comprise a center brass-like snap located between the two spaced apart brass-like snap members so as to present a normal jean-like structure with a plurality of brass-like snaps along the waist band.

DETAILED DESCRIPTION

Figure 1:
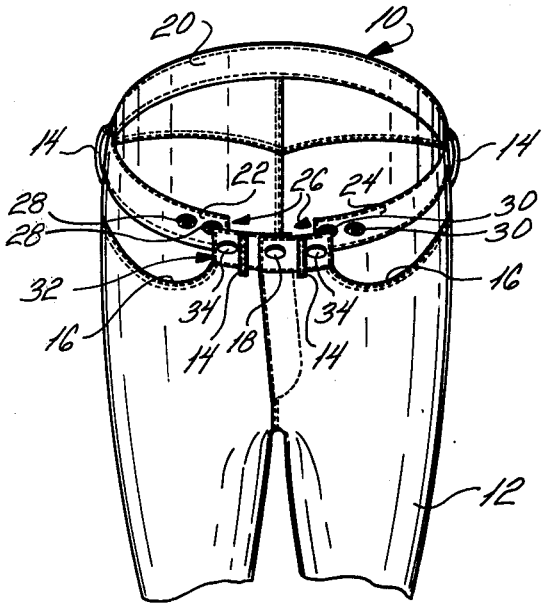
FIG. 1 is a front perspective view of an embodiment of my invention illustrating jean-like pants.

The waist band 10 of a pair of trousers 12 as illustrated in FIG. 1 with conventional loop members 14 regularly spaced around the waist band. A pair of front pockets 16 is provided and the jeans are formed with a brass like snap 18 serving to close the front of the jeans in a conventional fashion. As illustrated, the front pockets 16 are "western-type pockets" instead of "side seam" pockets. The western-type pocket has a cut in the front, and there is frontal room for a hand to be inserted in the pocket.

In accordance with this invention, there are provided means to adjust the waist band size and these are formed of a waist band section 20 partially encircling the wearer and terminating in spaced apart front sections 22 and 24, with a gap 26 formed between the front sections. A pair of horizontally spaced apart male snap members 28—28 are affixed to section 22, while horizontally spaced apart male snap members 30—30 are affixed to section 24. The spacing between the snap members permits adjustability of the waist band size as will be described in more detail hereinafter.

A front closing section 32 is provided which bridges gap 26 in order to enable the wearer to be completely encircled, and the front section 32 which comprises two horizontally spaced apart brass-like female snap members 34—34 spaced on either side of center snap 18. In order to adjust the waist band size, female snap members 34—34 are adapted to cooperate with male snap members 28—28 or 30—30 to achieve the desired waist band size. As may be understood, by employing ornamental female snap members 34—34, the normal ornamental decoration of the jeans is employed, thus enhancing the ornamental appearance of the jeans and simultaneously achieving the desirable waist band adjustable feature of my invention, such ornamental snaps may be formed of brass, pearl, enamel, or other similar materials.

Figure 2:
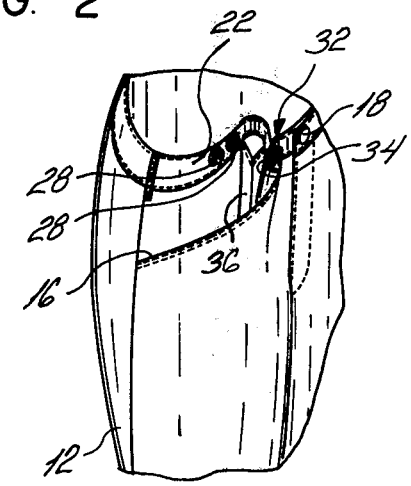
FIG. 2 is a partial perspective view of an embodiment of my invention illustrating the waist band and front section to be formed as a pleated segment.
Figure 3:
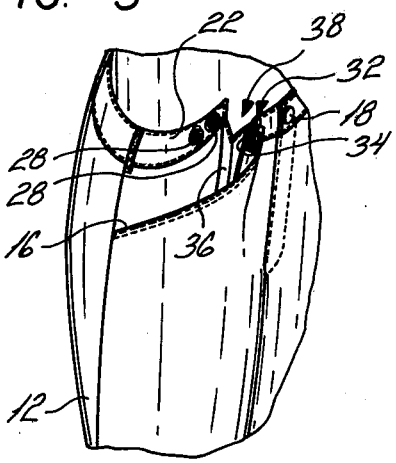
FIG. 3 is yet another embodiment of my invention with a gap or break formed between the front section and waist band section.

Referring to FIG. 2, there is shown one embodiment for achieving my invention, and a partial perspective diagram of one side of the jeans is illustrated. In particular, members 28—28 which are part of the waist band section cooperate with member 34 which is part of the front section, with waist band section 22 integrally formed with front section 32 so as to form a pleat when the snap members 34 and 28 are joined together. The two sections 22 and 32 are further held together by means of a connecting section 36 formed in the top portion of pocket 16, and referring now to FIG. 3, there is shown another partial perspective view of my invention in which the front section 32 is broken away from waist band section 22 as at gap 38. In this embodiment, the connecting section 36 retains front section 32 to waist band section 22, and the adjustable waist band feature is achievable without a pleat being formed in the front of the jeans.

The above description illustrates several embodiments of my invention, and other embodiments employing the principles described above may be formed by others skilled in the art without departing from the spirit and teachings of my invention.

What is claimed is:

1. For jeans and other trousers employing ornamental snap fastening members, an adjustable waistband comprising a waistband section affixed to the jeans partially encircling the wearer and terminating with a gap in the front, comprising at least a pair of horizontally spaced apart male snap members affixed to each side of said waistband section forming said gap, said jeans comprising western style slash pockets having the pocket opening in the front of the jeans with a front cutaway, said male snap members being affixed to the jeans in the proximity of the respective center front locations of the western pockets, and a front closing section formed of the same material as said jeans and bridging said gap and closing said waistband section to encircle said wearer comprising at least two horizontally spaced apart ornamental female members cooperating with a respective pair of male snap members to adjust the size of the waistband, each of said female member being positioned at the center termination of respective opposite slash pockets to be located in said waistband section whereby the ornamental snap members appear to be part of the normal ornamental decoration of said jeans in the front of the waistband section.

2. An adjustable waistband for jeans as set forth in claim 1, wherein said front closing section comprises a center ornamental snap located between said two spaced apart ornamental female snap members in the waistband section.

3. An adjustable waistband for jeans as set forth in claim 2, wherein said front closing section comprises two separable segments, with one segment comprising a male snap member of said center ornamental snap and the other segment comprising an ornamental female snap member of said center snap cooperating with said male snap member of said one segment to form said center snap, whereby said jeans are put on in the formal fashion by closing the center snap.

4. An adjustable waistband for jeans as set forth in claim 1, whereby the top portion of said waistband section is integrally connected with the top portion of said front closing section such that a pleat is formed therebetween when the pants are closed.

5. An adjustable waistband for jeans as set forth in claim 1 further comprising a pair of connecting sections located in the opposite front pocket sections of said jeans joining the front section to each respective side forming said gap of said waistband section, whereby when said jeans are closed on the wearer, a conventional non-pleated waistband is formed.

* * * * *